US006652322B2

(12) United States Patent
Ito et al.

(10) Patent No.: US 6,652,322 B2
(45) Date of Patent: Nov. 25, 2003

(54) CARD-EDGE CONNECTOR

(75) Inventors: Toshiyasu Ito, Togane (JP); Yasuhiro Ono, Yokohama (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 10/067,891

(22) Filed: Feb. 8, 2002

(65) Prior Publication Data

US 2002/0119704 A1 Aug. 29, 2002

(30) Foreign Application Priority Data

Feb. 9, 2001 (JP) ..... 2001-034323

(51) Int. Cl.[7] ..... H01R 23/70
(52) U.S. Cl. ..... 439/637; 439/857
(58) Field of Search ..... 439/637, 639, 439/60, 802, 636, 657, 858, 862, 861

(56) References Cited

U.S. PATENT DOCUMENTS

| | | | | |
|---|---|---|---|---|
| 1,477,527 A | * | 12/1923 | Raeting | 200/282 |
| 3,040,291 A | * | 6/1962 | Schweitzer | 439/637 |
| 3,601,774 A | * | 8/1971 | Stathos et al. | 439/637 |
| 3,631,381 A | * | 12/1971 | Pittman | 439/637 |
| 4,220,382 A | | 9/1980 | Ritchie et al. | 339/17 |
| 4,392,705 A | | 7/1983 | Andrews, Jr. et al. | |
| 4,507,697 A | | 3/1985 | Ozil et al. | |
| 4,734,041 A | * | 3/1988 | Bruchmann et al. | 439/637 |
| 4,850,899 A | | 7/1989 | Maynard | 439/628 |
| 5,401,185 A | * | 3/1995 | Wang et al. | 439/441 |
| 5,716,221 A | | 2/1998 | Kantner | |
| 5,725,385 A | | 3/1998 | Takano et al. | |
| 5,904,597 A | | 5/1999 | Doi et al. | |
| 5,928,027 A | | 7/1999 | Kunishi | 439/495 |
| 5,933,328 A | | 8/1999 | Wallace et al. | |
| 5,993,261 A | | 11/1999 | Klatt et al. | |
| 6,004,155 A | | 12/1999 | Wu | |
| 6,036,548 A | | 3/2000 | Braithwaite | |

(List continued on next page.)

FOREIGN PATENT DOCUMENTS

| | | |
|---|---|---|
| JP | 47-41714 | 10/1972 |
| JP | 50-56987 | 9/1975 |
| JP | 61-118980 | 6/1986 |
| JP | 06-036834 | 2/1994 |
| JP | 8-236187 | 9/1996 |
| JP | 11-111402 | 4/1999 |
| JP | 2000-251024 | 9/2000 |
| JP | 2000-251025 | 9/2000 |
| JP | 2002-117945 | 4/2002 |
| JP | 2002-124343 | 4/2002 |

OTHER PUBLICATIONS

U.S. patent application Ser. No. 09/840,109, filed Apr. 24, 2001, T. Nishimura.

U.S. patent application Ser. No. 09/842,083, filed Apr. 26, 2001, T. Nishimura.

(List continued on next page.)

*Primary Examiner*—Lynn Feild
*Assistant Examiner*—Phuong K T Dinh
(74) *Attorney, Agent, or Firm*—Finnegan, Henderson, Farabow, Garrett & Dunner, L.L.P.

(57) ABSTRACT

Each the contact terminal includes a plurality of contact units stacked with each other, wherein contact point sections of the respective contact units are distributed to disperse in lengthwise direction of the contact terminal within the corresponding contact pad. The distal end of the innermost contact unit in the plurality of stacked contact units extends to a position at which it is not entangled with the distal end of the adjacent contact unit.

13 Claims, 11 Drawing Sheets

U.S. PATENT DOCUMENTS

| | | | | |
|---|---|---|---|---|
| 6,099,335 | A | | 8/2000 | Chang |
| 6,102,715 | A | | 8/2000 | Centofante |
| 6,162,075 | A | | 12/2000 | Hara et al. ..... 439/159 |
| 6,162,089 | A | | 12/2000 | Costello et al. |
| 6,174,198 | B1 | | 1/2001 | Wu et al. |
| 6,176,737 | B1 | | 1/2001 | Choy |
| 6,183,292 | B1 | | 2/2001 | Chen et al. |
| 6,224,391 | B1 | | 5/2001 | Horie et al. ..... 439/64 |
| 6,250,965 | B1 | | 6/2001 | Neifer |
| 6,250,966 | B1 | | 6/2001 | Hashimoto et al. ..... 439/631 |
| 6,261,128 | B1 | | 7/2001 | Heim et al. |
| 6,315,615 | B1 | * | 11/2001 | Raistrick ..... 439/637 |
| 6,328,605 | B1 | | 12/2001 | Walker et al. |
| 6,402,529 | B2 | | 6/2002 | Saito et al. |
| 6,409,546 | B1 | | 6/2002 | Ito et al. |
| 6,508,661 | B1 | | 1/2003 | Yu ..... 439/495 |
| 6,511,349 | B2 | | 1/2003 | Ishikawa et al. ..... 439/631 |

OTHER PUBLICATIONS

U.S. patent application Ser. No. 09/922,866, filed Aug. 7, 2001, T. Ito et al.

U.S. patent application Ser. No. 09/978,664, filed Oct. 18, 2001, S. Sato.

U.S. patent application Ser. No. 10/046,716, filed Jan. 17, 2002, M. Ooya et al.

U.S. patent application Ser. No. 10/057,944, filed Jan. 29, 2002, S. Mithuhashi et al.

U.S. patent application Ser. No. 10/090,800, filed Mar. 6, 2002, T. Takeyama et al.

Japanese Office Action and English Translation dated Jan. 21, 2003.

* cited by examiner

CARD-EDGE CONNECTOR

This application is based on Patent Application No. 2001-343235 filed Feb. 9, 2001 in Japan, the content of which is incorporated hereinto by reference.

BACKGROUND OF THE INVENTION

1. Field of the Invention

The present invention relates to a card-edge connector (edge-socket connector) wherein a plurality of contact terminals formed therein are respectively brought into contact with a plurality of contact pads formed at one end of an edge board by loading the edge board into the connector, developed for electrically connecting the card-edge connector with a printed circuit board or a cable via such contact, particularly improved to a card-edge connector capable of reducing the temperature rise of the contact terminals and improved to prevent the latter from being entangled with each other.

2. Description of the Related Art

The card-edge connector is used for electrically connect an edge board to a main board or others of various electronic equipments. The edge board includes a plurality of electro-conductive contact pads arranged on one side or both sides of an end portion of a printed circuit board on which electric circuits are formed. The card-edge connector of this type generally has a rectangular housing. Also the card-edge connector has in the interior of the housing a recess into which the edge board is inserted and a plurality of elastic contact terminals arranged on one side or both sides of a member in which the recess is formed and others.

As such a card-edge connector, a double-sided type card-edge connector has been known for loading therein a double-sided edge board arranged the contact pads on both sides of a printed circuit board. In such a double-sided card-edge connector, a plus voltage is supplied to the contact pads on one side of the edge board and a minus voltage is supplied to those on the other side thereof when an electrical power is supplied to the edge-connector from a main board including the connector, or when a large power is supplied to the edge board through cable or the like for connection with the edge-connector.

The contact terminal to be brought into contact with the contact pad is formed of a spring piece. The contact terminal includes a terminal section to be electrically connected to the main board or a cable, a fixed part secured to a connector housing, a spring piece section consecutive to the fixed part and a contact point section.

In the conventional card-edge connector, one contact terminal corresponds to each of the contact pads in the edge board is provided. Since it is designed that one contact point section of the respective contact terminal is brought into contact with the contact pad (a one-point contact), the temperature can rise in all of the terminal section, the fixed part, the spring piece section and the contact point section in the respective contact terminal when a large power is supplied to the edge board whereby a large current flows between the contact section of the respective contact terminal and the contact pad. Accordingly, the conventional card-edge connector has a problem in that the rated current becomes low.

SUMMARY OF THE INVENTION

The present invention has been made in consideration of such circumstances, and an object thereof is to provide a card-edge connector capable of enhancing the rated current even if a large power is supplied to the respective contact terminal of a card-edge connector, has additional advantage of being able to prevent the contact terminals from entangling with each other.

In an aspect of the present invention, there is provided a card-edge connector comprising a connector housing having a recess into which is inserted a printed circuit board having a plurality of contact pads arranged on at least one side of an end portion thereof, and a plurality of contact terminals, each having a fixed part to be secured to the connector housing, an elastically deformable spring piece section extending from the fixed part and having a contact point section at a distal end thereof; the card-edge connector bringing the contact pads on the printed circuit board inserted thereinto into contact with the contact point sections of the plurality of contact terminals, wherein the contact terminal is formed of a plurality of contact units stacked with each other so that the contact point sections of the respective contact units in each layer are distributed to disperse in the lengthwise direction of the contact terminal within the contact pad, and spring piece sections of the contact units except an innermost contact unit is folded back at a midpoint to be formed a hook-shape, a contact point section of the innermost contact unit is formed to arcuate-shape, and a distal end of the innermost contact unit in the plurality of stacked contact units extends to a position at which it is not entangled with a distal end of the adjacent contact unit.

The temperature rise of the contact terminal is determined by the conductor resistance of the contact terminal, and the smaller the resistance, the less the temperature rise. The conductor resistance of the contact terminal is determined by a dielectric constant inherent to material of the contact terminal and a cross-sectional area of a portion through which the electric current flows, wherein if the contact terminals are made of the same material, one having a larger cross-sectional area is smaller in conductor resistance.

On the other hand, a contact resistance generates in the contact terminal at a position brought into contact with the contact pad of the printed circuit board; i.e., a contact point section. The contact resistance is determined by an area of the contact point section of the contact terminal with the contact pad, and the larger the contact area, the less the temperature rise. A size of the contact area is defined by a width of the contact point section and the number of contact point sections, and the larger the width of the contact point section and the more the contact point sections, the less the temperature rise.

According to the present invention, the temperature rise is restricted by forming one contact terminal from a plurality of contact units stacked together to increase a cross-sectional area of the contact terminal. In addition, the contact point sections of the respective stacked contact units are arranged to disperse in the lengthwise direction of the contact terminal within the contact pad, whereby the number of contact point sections increases to restrict the temperature rise.

In this regard, if the contact point sections of the respective contact units are brought into contact with a narrow area of the contact pad in the printed circuit board by using the plurality of stacked contact units, it is necessary to arrange the contact point sections of the respective contact units close to each other. Since the respective contact point sections of these contact units variously moves during the insertion and withdrawal of the printed circuit board, there may be a case in which the contact point section of one contact piece rides on that of the adjacent contact piece to entangle with each other. In such a case, the contact point sections of part of the contact units may not be brought into contact with the contact pads of the printed circuit board, whereby an effect is not obtainable which is to be expected from the contact terminal of the above-mentioned multi-contact point system.

Thus, in the present invention, the above-mentioned entanglement is prevented by extending a distal end portion of the innermost contact unit among the plurality of stacked contact units extends to a position at which it is not entangled with a hook-shaped distal end of the adjacent contact unit.

As described above, according to the present invention, the cross-sectional area of the contact terminal increases by constituting the contact terminal from a plurality of stacked contact units so that the temperature rise is restricted. Further, the contact point sections of the respective stacked contact units are arranged to disperse in the lengthwise direction of the contact terminal within the contact pad so that the number of contact point sections increases to restrict the temperature rise.

Also according to the present invention, since a distal end portion of the innermost contact unit among a plurality of stacked contact units extends to a position at which the former is not entangled with a distal end of the adjacent contact unit, the entanglement of the distal end portions of the respective contact units is assuredly prevented. Thus, it is possible to assuredly avoid the inferior contact of the contact unit to result in the expected effect due to the contact terminal having multi-contact points.

Also according to the present invention, since the spring piece section of the respective contact unit is split into a plurality of spring piece units in the widthwise direction it is possible to assuredly bring the contact point sections of the respective spring piece units into the contact pad.

The above and other objects, effects, features and advantages of the present invention will become more apparent from the following description of embodiments thereof taken in conjunction with the accompanying drawings.

DETAILED DESCRIPTION OF PREFERRED EMBODIMENTS

One embodiment of the present invention will be described below with reference to the attached drawings.

Figure 1:
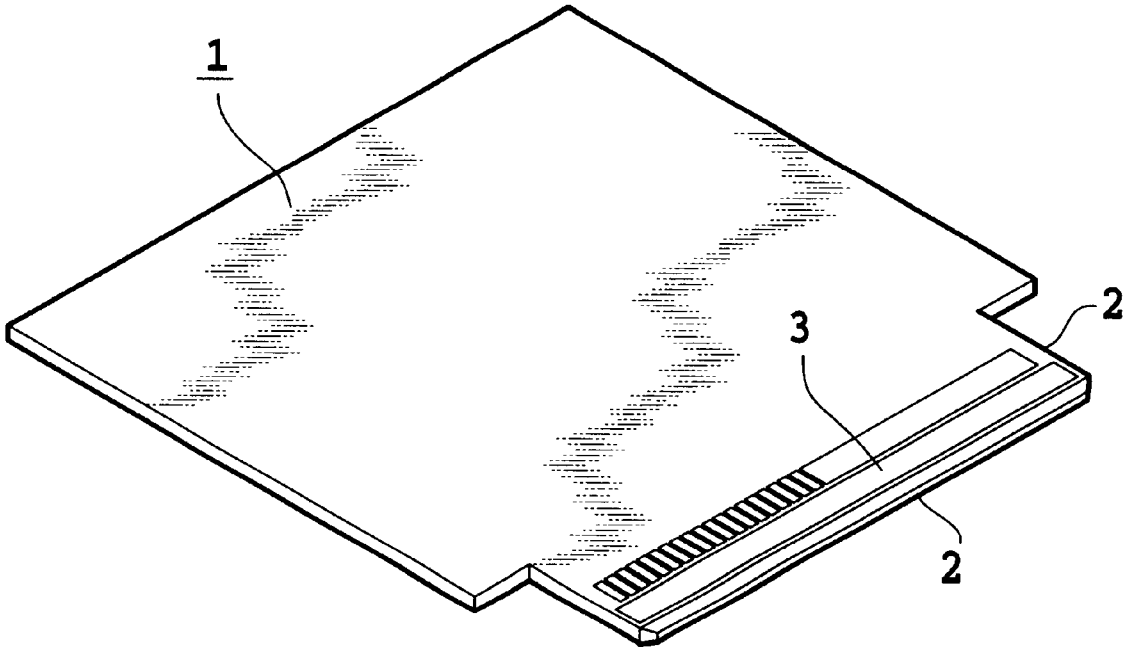
FIG. 1 is a perspective view showing an appearance of a front side of one embodiment of an edge board.
Figure 2:
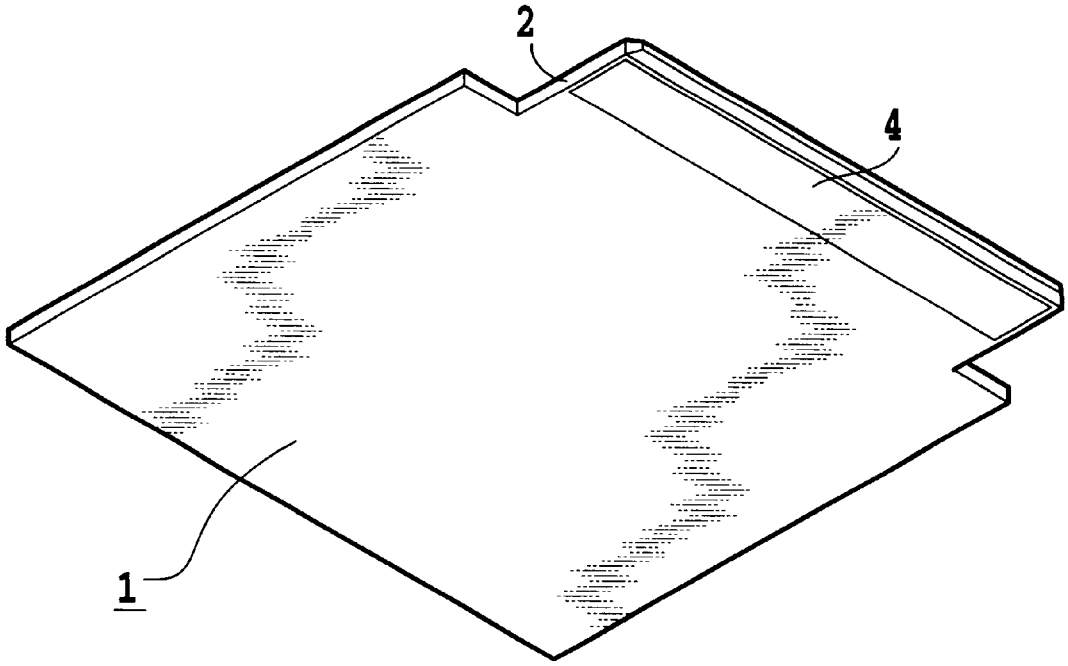
FIG. 2 is a perspective view showing an appearance of a back side of the one embodiment of an edge board.

FIGS. 1 and 2 illustrate an edge board 1; wherein FIG. 1 shows an appearance of a front side of the edge board 1 and FIG. 2 shows an appearance of a back side of the edge board 1.

As shown in FIGS. 1 and 2, on the front and back sides of a card edge section 2 of the edge board 1 in which electric circuits are formed, are arranged a plurality of contact pads 3, 4 respectively. The each contact pads 3 and 4 are arranged at a predetermined mutual spacing in the widthwise direction.

Figure 3:
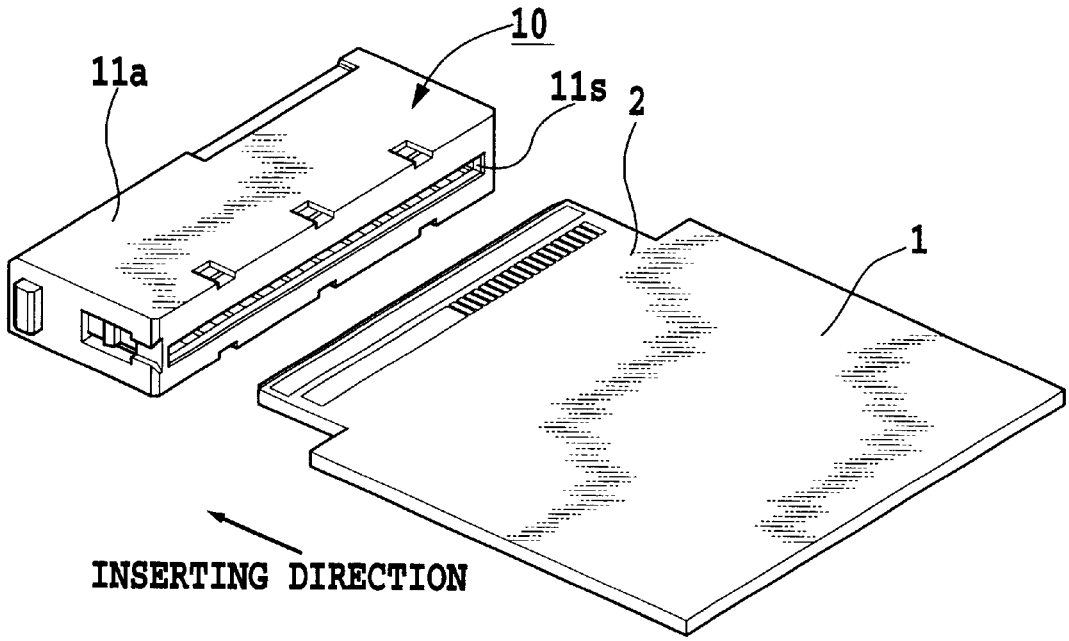
FIG. 3 is a perspective view showing an edge board with the edge board inserted into a card-edge connector of the present invention.
Figure 4:
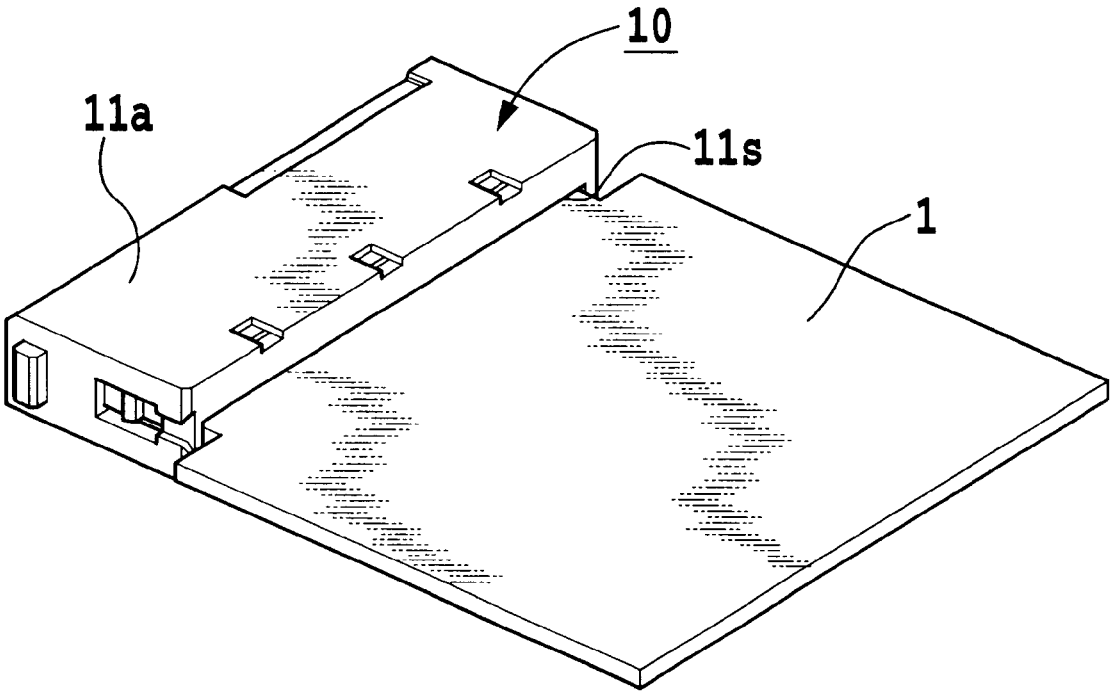
FIG. 4 is a perspective view showing an appearance of the card-edge connector shown in FIG. 3 with an edge board loaded into the card-edge connector.

As shown in FIG. 3, this edge board 1 is inserted into a card-edge connector 10 in the direction shown by the arrow, i.e., the inserting direction through an opening 11*s*, while directing the card edge section 2 forward. As a result, as shown in FIG. 4, the card edge section 2 of the edge board 1 is loaded to the interior of the card-edge connector 10.

Figure 5:
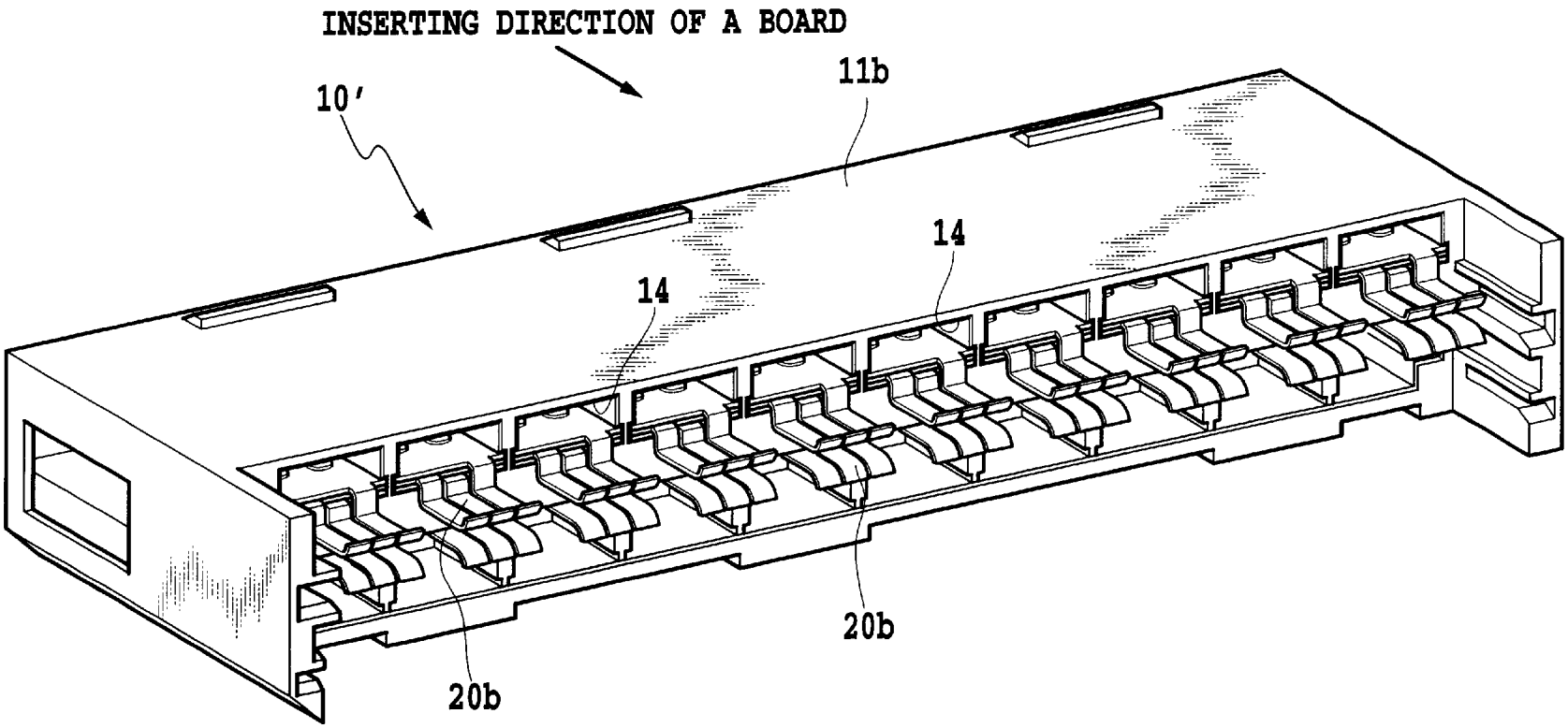
FIG. 5 is a perspective view showing the card-edge connector shown in FIG. 3 as seen from a back side with an outer housing thereof being removed.
Figure 6:
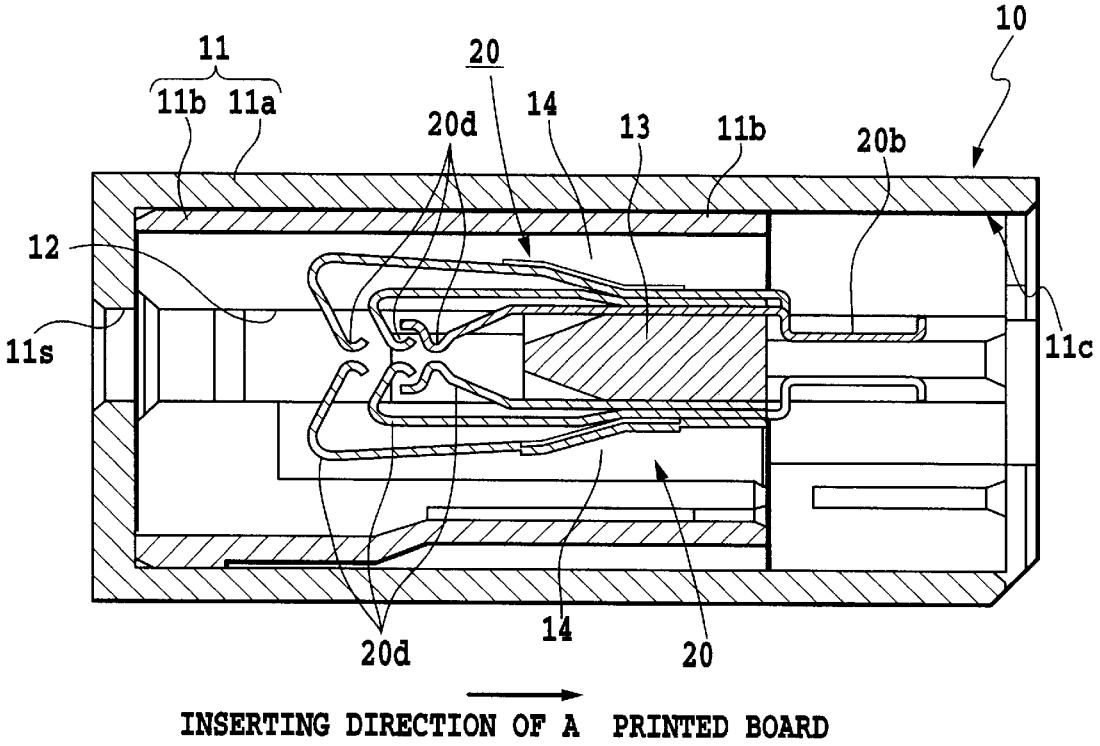
FIG. 6 is a sectional view showing the card-edge connector shown in FIG. 3 with an edge board being unloaded thereto.
Figure 7:
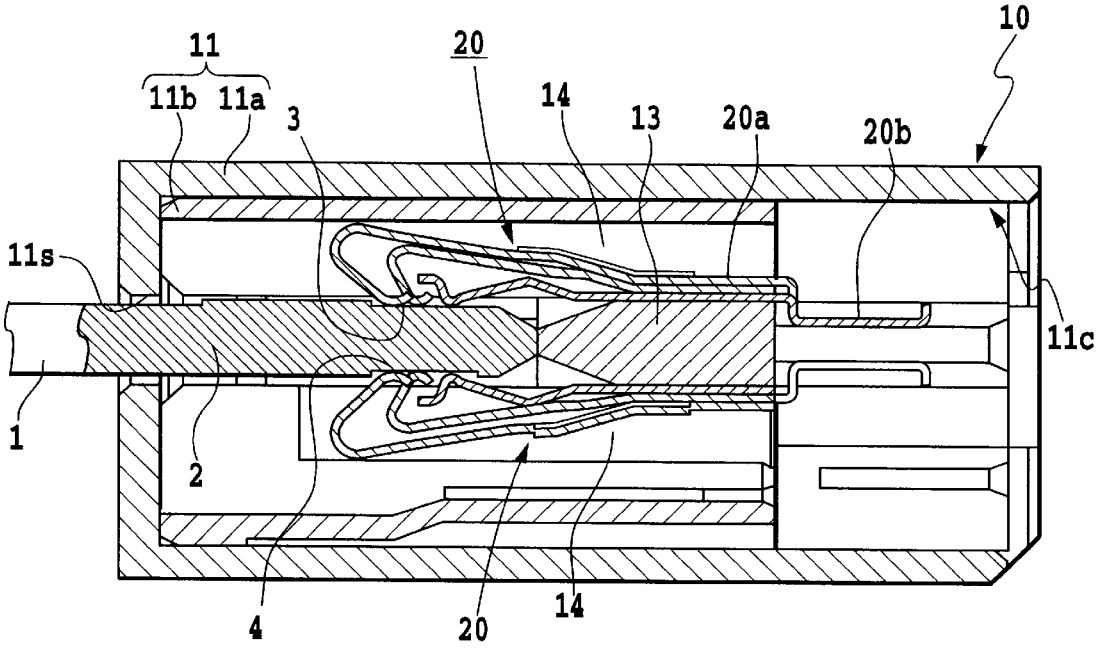
FIG. 7 is a sectional view showing the card-edge connector shown in FIG. 4 with the edge board being loaded thereto.

FIG. 5 is a perspective view of a card-edge connector 10' from which is removed an outer housing 11*a*, as seen from a rear side thereof, and FIG. 6 is a sectional view of the card-edge connector 10 when the edge board 1 is not yet loaded. FIG. 7 is a sectional view showing the card-edge connector 10 when the edge board 1 has been loaded.

As shown in these drawings, the card-edge connector 10 has a connector housing 11 formed of resin or the like. In this embodiment, the connector housing 11 has the outer housing 11*a* and an inner housing 11*b*.

The outer housing 11*a* for protecting terminal sections 20*b* of contact terminals 20 described later has a portion 11*c* for accommodating the inner Housing 11*b* inserted therein. One end of the portion 11*c* opens to allow the inner housing 11*b* to be inserted thereinto, while the other end of the portion 11*c* is closed with a wall formed integral with the other portion of the outer housing 11*a*. In the wall, a slit 11*s* extending in the longitudinal direction of the outer housing 11*a* is formed for allowing the card edge section 2 of the edge board 1 to pass through the same. The outer housing 11*a* and the inner housing 11*b* are connected together by engaging hooks provided along a longer side of a flat surface of the inner housing 11*b* with elongate holes provided along a longer side of a flat surface of the outer housing 11*a*.

As shown in FIG. 6, the inner housing 11*b* has a rectangular slot-shaped recess 12 formed on the opposite side of the slit 11*s* of the outer housing 11*a* and opening at one end (on a top surface). This recess 12 for guiding the edge board 1 has a predetermined depth and is formed to extend in the longer direction of the inner housing 11*b* (in a vertical direction to the paper plane in FIG. 6). Accordingly, the recess 12 is formed to penetrate each of partitioning walls defining a contact accommodating portion 14 described later.

A bottom plate member 13 is provided within the contact accommodating portion 14 described later to be flush with a bottom surface of the recess 12 and the bottom plate member 13 is brought into contact with a distal end of the card edge section 2 of the edge board 1 inserted through the slit 11*s* of the outer housing 11*a* and guided with the recess 12. The bottom plate member 13 is formed to extend in the longer direction of the inner housing 11*b* generally parallel to the recess 12 (in the vertical direction to the paper surface in FIG. 6).

As shown in FIG. 5, the inner housing 11*b* is provided with a plurality of contact accommodating portion (holes) 14 for arranging the contact terminals 20 generally orthogonal to the extending direction of the recess 12. The contact accommodating portion 14 are arranged at a predetermined spacing in the longer direction of the inner housing 11*b*. The every adjacent contact accommodating portion 14 are sectioned by a partitioning wall. The recess 12 as above is formed through the respective partitioning walls.

On the rear side of the respective contact accommodating portion 14, a press-fit groove (not shown) is formed for press-fitting the fixed part of the contact terminal 20.

As shown in FIG. 6, there are a pair of contact terminals 20 made of elastic conductive metal and opposed to each other in the respective contact accommodating portion 14.

Figure 8:
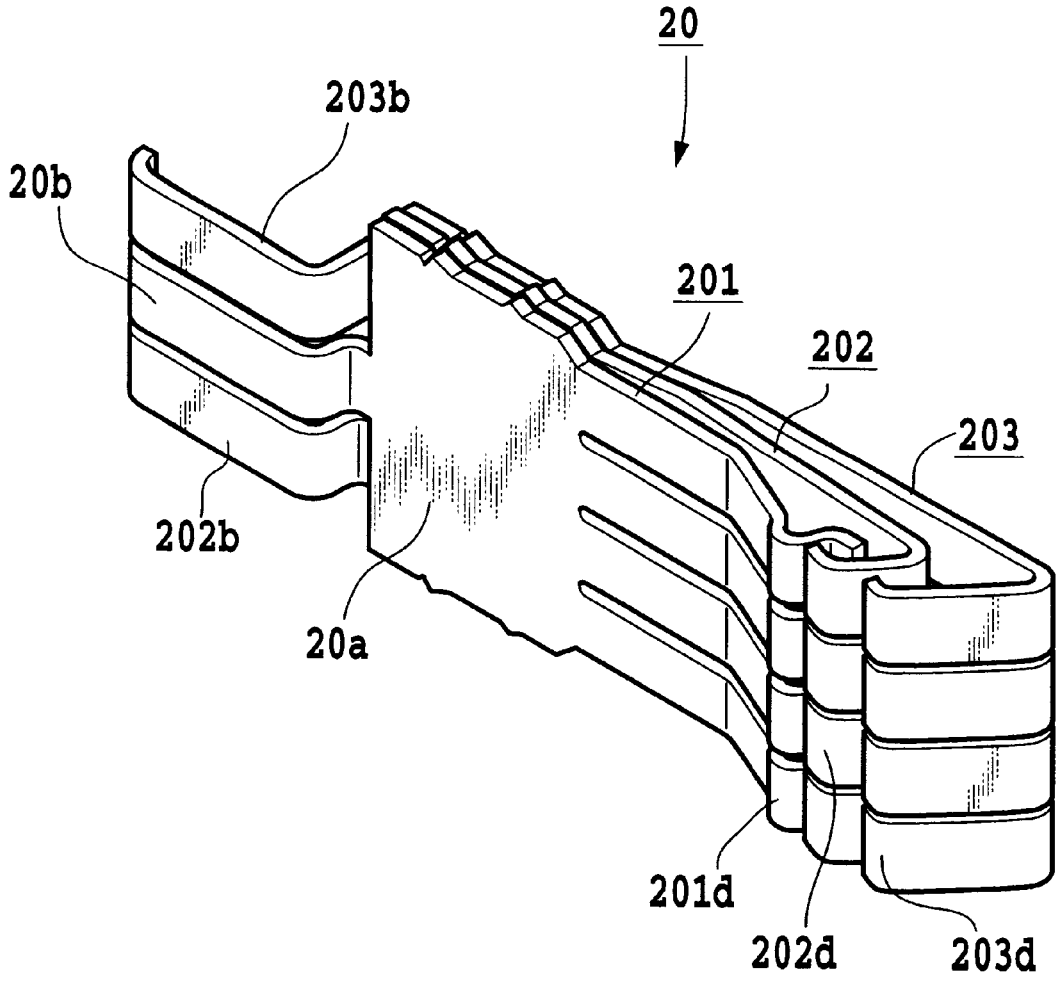
FIG. 8 is a perspective view showing an embodiment of a contact terminal.
Figure 9:
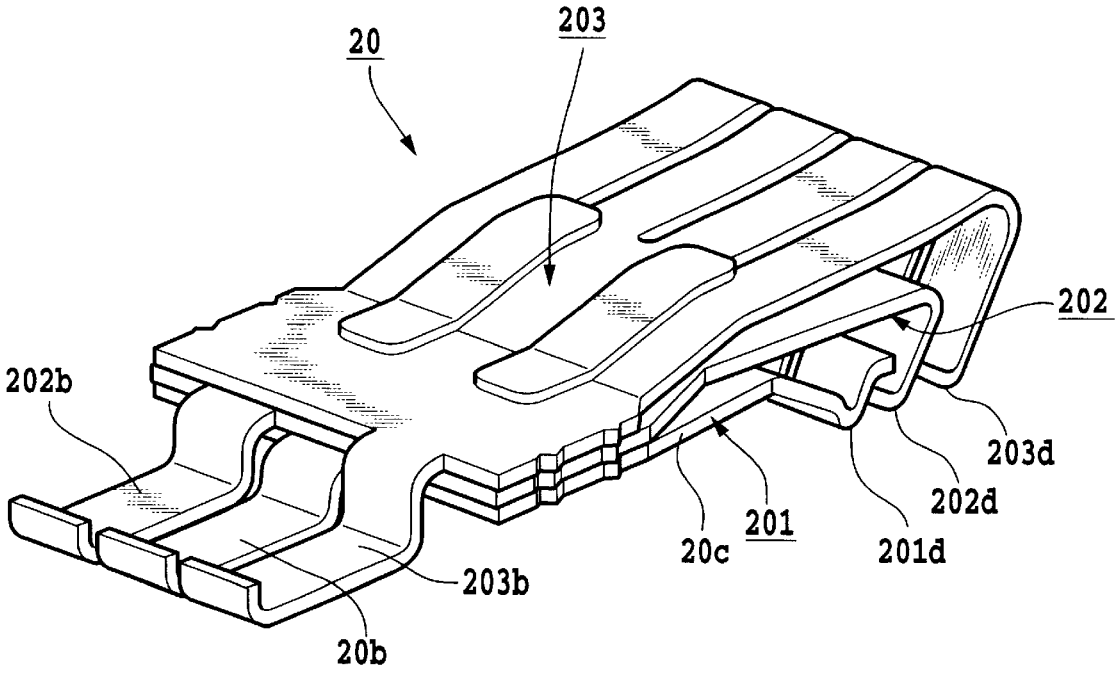
FIG. 9 is a perspective view showing an embodiment of a contact terminal.
Figure 10:
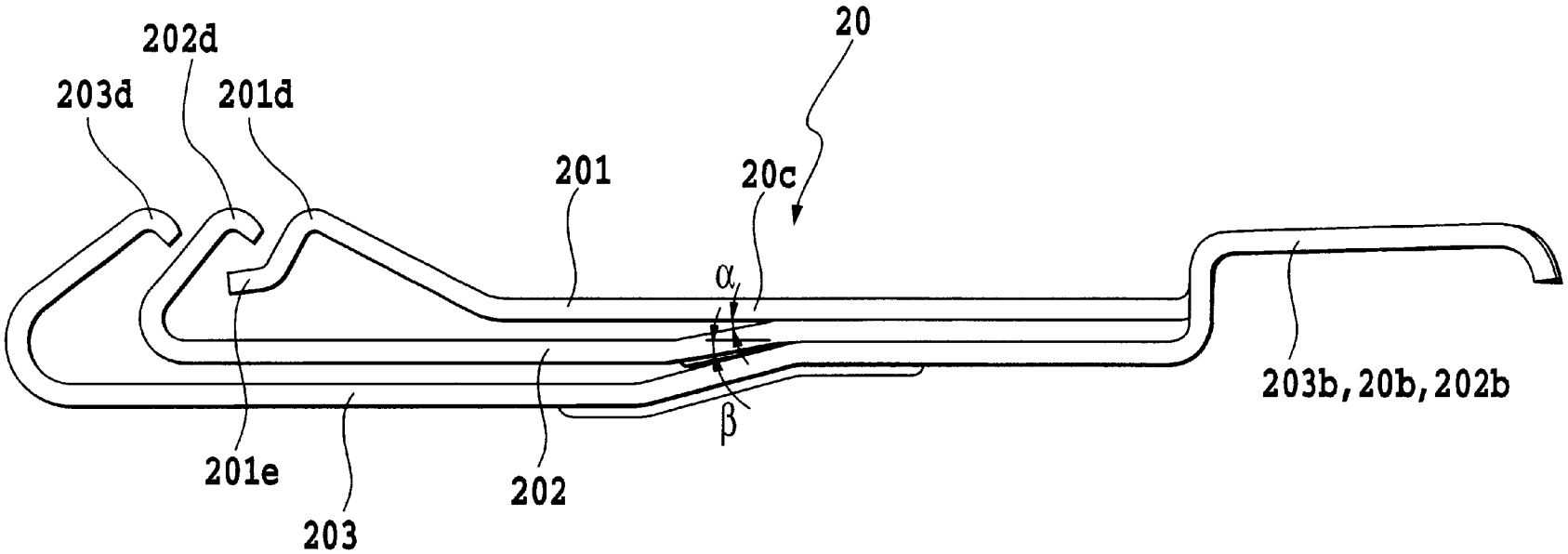
FIG. 10 is a side view showing the contact terminal shown in FIGS. 8 and 9.

FIGS. 8 and 9 are perspective views illustrating a concrete shape of the respective contact terminal 20; FIG. 10 is a side view illustrating the same contact terminal 20; and FIG. 11 illustrates one (the innermost) contact unit 201.

As shown in these drawings, the contact terminal 20 is constituted by three contact units 201, 202 and 203 stacked with each other.

A total length of the contact unit 201 is shorter than those of the other two contact units 202 and 203, and the total length of the contact unit 203 is longer than those of the other two contact units 210 and 202. The contact unit 202 is stacked on a top surface of the contact unit 201, and the contact unit 203 is stacked on a top surface of the contact unit 202. Widths of the fixed parts of the respective contact units 201, 202 and 203 are substantially equal to each other.

Figure 11:
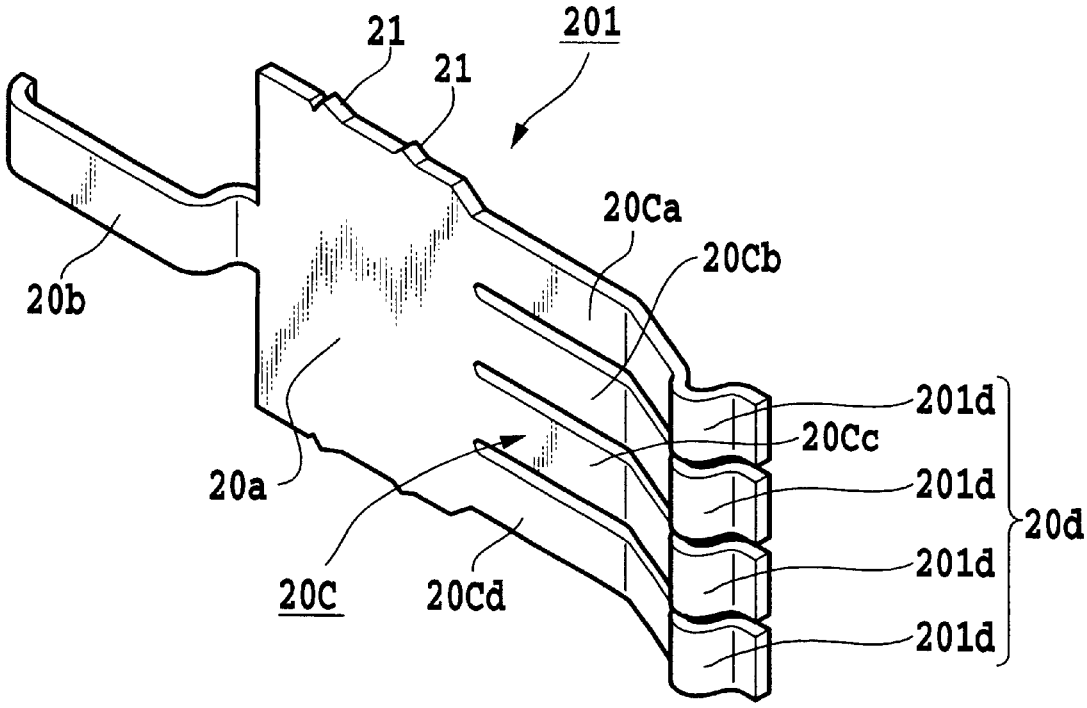
FIG. 11 is a perspective view showing one contact unit.

As shown in FIG. 11, the contact unit 201 is formed of a cantilever-like spring piece having a fixed part 20*a* to be press-fit into the press-fit groove, a terminal section 20*b* extending from the fixed part 20*a* to be connected to a main board or a cable, and an elastically deformable spring piece section 20*c*.

Also, each of the contact units 202 and 203 includes the fixed part, the terminal section and the spring piece section in the same manner as in the contact unit 201.

The spring piece section 20C is bent at a predetermined angle relative to the fixed part 20*a* or formed in flush with the fixed part 20*a*, and has at a distal end thereof a contact point group 20*d* to be in contact with one contact pad 3 or 4 in the edge board 1. On opposite lateral sides of the fixed part 20*a*, there are plurality of engagement projections 21, respectively.

The spring piece section 20*c* of the contact unit 201 is split into a plurality of (four-way split in this embodiment) spring piece units 20C*a*, 20C*b*, 20C*c* and 20C*d* with a predetermined gap between the adjacent ones (see FIG. 11) across the contact terminal 20. An overall width of the spring piece section 20C of the respective contact unit 201, 202 or 203 split into these four spring piece units 20C*a* to 20C*d* is set so that the respective spring piece unit can be brought into contact with one contact pad 3 or 4.

Similarly, the spring piece section of the contact unit 202, 203 is split into four spring piece units.

The contact point group 20*d* in each of the three contact units 201, 202 and 203 is formed of a plurality of contact point sections 201*d*, 202*d* and 203*d*, respectively. There are, for example, four contact point sections in the contact point group 20.

When its attention is paid to contact point sections 201*d*, 202*d* and 203*d*, as shown in FIGS. 8 and 9, these contact point sections 201*d*, 202*d* and 203*d* are distributed to disperse in the lengthwise direction of the contact terminal 20 (a direction orthogonal to the widthwise direction of a distal end of the card edge section 2) within a size (a area to be contacted) of one contact pad 3 or 4 in accordance with an overall length of each the contact unit 201, 202, 203 stacked with each other.

The contact terminal 20 is constituted in such a manner that the contact point sections 201*d*, 202*d* and 203*d* of the three contact units 201, 202 and 203 stacked with each other are arranged to disperse in the lengthwise direction of the contact terminal 20 at a predetermined gap within a narrow range.

As shown in FIG. 10, regarding the contact units 202 and 203 located at a medial position and a position closest to the inner surface (the outermost position) of inner housing 11*b*, respectively, rising angles $\alpha$ and $\beta$ of the spring piece sections are set larger than the rising angle of the corresponding spring piece section of the contact unit 201, and each of the spring piece sections of the former two is folded back at a midpoint toward the contact point section 201*d* side of the contact unit 201 to form a hook-shape. The angle $\beta$ is set larger than the angle $\alpha$.

The contact point sections 202*d* and 203*d* of the contact units 202, 203 are bent to have a crest-shaped (a rounded shape) not to be caught by the edge board 1 or not to injure the contact pad during the slide thereof.

Thereby, the contact point section 203*d* of the contact unit 203 is located at a position farthest from the contact point section 201*d* of the contact unit 201 while the contact point section 202*d* of the contact unit 202 intervening between two contact point section.

On the other hand, the spring piece section of the innermost contact unit 201 in relation to the inner surface of the inner housing 11*b* has no such a folded-back shaped as described above. The contact point section 201*d* thereof is generally arcuate. Also, a distal end of 201*e* (see FIG. 10) of the contact point section 201*d* of the innermost contact unit 201 extends to a position at which it is not entangled with a distal end of the contact point section 202*d* of the adjacent contact unit 202. In other words, the distal end 201*e* is formed to be capable of entering a space defined by the hook-shaped spring piece section of the contact unit 202 without interfering with the contact point section 202*d*.

Accordingly, it is possible to prevent the distal ends of the contact units 201 and 202 from entangling with each other (that is, to prevent the distal end 201*e* of the contact unit 201 from riding over the contact point section 202*d* of the contact unit 202) when the respective contact units are elastically deformed or restored.

In this embodiment, the respective contact point sections of the four-split spring piece units in one contact unit have approximately the same width. Also, the contact point sections of the spring piece units in the respective contact units 201, 202 and 203 have the same width each other.

On the other hand, the proximal end of terminal portion 20*b* of the contact unit 201 is coupled to a generally middle portion of an end of the fixed part 20*a*. Also, the proximal end of the terminal section 202*b* of the contact unit 202 is coupled to a portion of the end of the fixed part leaning to one side thereof. While, the proximal end of the terminal section 203*b* of the contact unit 203 is coupled to a portion of the end of the fixed part leaning to the other side thereof.

According to this structure, where the terminal sections 20*b*, 202*b* and 203*b* of the contact units 201, 202 and 203 are concerned, when the three contact units 201, 202 and 203 are stacked with each other, flat surfaces of the terminal sections 20*b*, 202*b* and 203*b* of the contact units 201, 202 and 203 are arranged side by side at a generally equal height (flush with each other in a common plane) as shown in FIGS. 8, 9 and 10.

That is, the respective terminal sections 20*b*, 202*b* and 203*b* of the plurality of contact units 201 to 203 are arranged to be shifted in the widthwise direction of the contact terminal 20.

This is because of the following reasons. Since a distance from the fixed part 20*a* of the contact unit 201 to the terminal section 20*b* to be soldered is short, the terminal sections 20*b*, 202*b* and 203*b* are arranged flush with each other in a common plane to facilitate the soldering operation.

Also, in this embodiment, since the fixed parts of the three contact units 201, 202 and 203 have a generally equal width, these contact units 201, 202 and 203 can be press-fit altogether into the above-mentioned groove of the connector housing.

According to such a card-edge connector, the card edge section 2 of the edge board 1 can be positioned at an open end of the recess 12 of the inner housing 11*b* via the slit 11*s* of the outer housing 11*a*, and the edge board 1 is inserted into the recess 12 until the distal end of the card edge section 2 reaches the bottom surface of the recess 12 (and touches to the bottom plate member 13) while pressing the pair of contact terminals 20 away from each other as shown in FIG. 7.

Thereby, the pair of contact terminals 20 bends so that the contact point sections 201*d*, 202*d* and 203*d* of the pair are distant from each other. Thus, the contact point sections 201*d*, 202*d* and 203*d* are brought into press-contact with the contact pads 3 and 4, resulting in the electric connection between the both.

In this regard, since the temperature rise in the contact terminal 20 is decided by the conductor resistance of the contact terminal 20, the smaller the resistance, the less the temperature rise. The conductor resistance of the contact terminal 20 is decided by a dielectric constant inherent to material of the contact terminal 20 and a cross-sectional area of a portion through which an electric current flows. If the material is identical, the larger the cross-sectional area, the smaller the conductor resistance of the contact terminal 20.

Accordingly, in this embodiment, the plurality of contact units 201, 202 and 203 are stacked with each other to configure the contact terminal 20 having a larger cross-sectional area. As a result, the temperature rise of the contact terminal 20 is restricted when the edge board 1 is inserted into the connector to operate.

On the other hand, a contact resistance generates at a position at which the contact terminal 20 is brought into contact with the contact pad 3 or 4 of the edge board 1; i.e., the contact point section. The contact resistance is decided by an area of the contact point section in contact with the contact pad 3, 4, and the larger the contact area, the less the temperature rise. The size of the contact area is decided by a width of the respective contact point section and the number of the contact point sections, and the wider the width and the more the number, the less the temperature rise of the contact terminal 20.

In this embodiment, since the contact terminal 20 is constituted so that the contact point sections 201*d*, 202*d* and 203*d* of the respective contact units 201, 202 and 203 are shifted to each other at a predetermined distance within the contact pad 3 or 4 in the lengthwise direction of the contact terminal 20, it is possible to increase the number of contact point sections in the contact terminal 20, whereby the contact resistance becomes smaller to suppress the temperature rise of the contact terminal 20.

In this regard, there may be a case wherein the contact area decreases even if the width of the contact point section is merely widened, since it is a rare case that the contact point section of the contact of the contact terminal 20 and the pad surface of the edge board 1 are completely parallel to each other and only part of the contact point section in the widthwise direction is brought into contact with the pad. To avoid such an inconvenience, according to this embodiment, the spring piece section of the contact unit 201, 202, 203 is split into a plurality of spring piece units in the widthwise direction.

That is, since the split spring piece units are deformable in a distorted manner due to the elasticity of the spring piece section when the edge board 1 is inserted, it is possible to assuredly bring the contact point sections of all the spring piece units into contact with the contact pads of the edge board 1.

Also, in this embodiment, since the distal end 201*e* of the innermost contact unit 201 described above extends to a position at which it is not entangled with the distal end of the adjacent contact unit 202, it is possible to assuredly prevent the distal end of the contact unit 201 from entangling with the distal end of the contact unit 202 when the respective contact units are elastically deformed or restored. Thus, it is possible to assuredly avoid the inferior contact of the contact unit to result in the expected effect due to the contact terminal having multi-contact points.

In this regard, while the contact terminal 20 is constituted by stacking a plurality of contact units with each other in the above embodiment, a contact terminal may be merely constituted by a single spring piece not being stacked but split into a plurality of spring piece units so that contact point sections are distributed to disperse in the widthwise and lengthwise directions within the contact pad. According to this structure, the number of contact point sections to be in contact with the contact pad increases in comparison with the prior art, whereby the contact resistance becomes smaller and the temperature rise in the contact terminal can be restricted.

Also, while the explanation has been made of the card-edge connector for the edge board having the contact pads on both sides thereof, the present invention may be applied to a connector for an edge board having contact pads solely on one side thereof.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A card-edge connector for electrically connecting to a printed circuit board having a plurality of contact pads arranged on at least one side of an end portion of the printed circuit board, comprising:

a connector housing having a recess into which the end portion of the printed circuit board is to be inserted, and a plurality of contact terminals, wherein each contact terminal is formed of a plurality of contact units wherein the contact units are stacked and wherein each contact unit comprises a fixed part to be secured to said connector housing and an elastically deformable spring piece section extending from said fixed part and having a contact point section at a distal end thereof to contact with at least one contact pad on said printed circuit board when said end portion of said printed circuit board is inserted into said card-edge connector, wherein:

said plurality of stacked contact units are configured so that the contact point sections are distributed to disperse in the lengthwise direction of said corresponding contact terminal, each spring piece section of said plurality of stacked contact units, except the spring piece section of an innermost contact unit, comprises a fold at a midpoint thereby extending the spring piece section back toward the contact point section of the innermost contact unit and forming a hook-shape, the contact point section of said innermost contact unit is formed to be arcuate-shape, and a distal end of said innermost contact unit extends to a position at which it is not entangled with a distal end of an adjacent contact unit.

2. A card-edge connector as defined in claim 1, wherein each contact point section of said plurality of stacked contact units, except the contact point section of said innermost contact unit, is bent.

3. A card-edge connector as defined in claim 1, wherein each spring piece section of said plurality of stacked contact units comprises a plurality of spring piece units disposed in a widthwise direction of said corresponding contact terminal.

4. A card-edge connector for electrically connecting to an edge board comprising a connecting section having a first group and a second group of electrode pads formed respectively on a first side and a second side of said connecting section, the card-edge connector comprising:

a housing portion for accommodating the connecting section of the edge board;

a positioning section for positioning said connecting section of said edge board in said housing portion so that said first and second groups of electrode pads are disposed in a predetermined direction;

a plurality of contact terminals arranged within said housing portion along said predetermined direction to electrically connect with said first and second groups of electrode pads of said edge board;

wherein said contact terminals comprise:

a plurality of first contact terminals, each first contact terminal having a plurality of contact point groups formed in substantially a same plane and arranged in a direction generally orthogonal to said predetermined direction of said first group of electrode pads, wherein the contact point groups of each first contact terminal are configured to be in contact with different positions of a corresponding electrode pad in said first group, and a plurality of second contact terminals arranged opposite to said plurality of first contact terminals at a predetermined distance, respectively, each second contact terminal having a plurality of contact point groups formed in substantially a same plane and arranged in a direction generally orthogonal to said predetermined direction of said second group of electrode pads, wherein the contact point groups of each second contact terminal are configured to be in contact with different positions of a corresponding electrode pad in said second group, and wherein each of the plurality of contact point groups of the first and second contact terminals is disposed at a distal end of a plurality of spring piece units joined with each other at one end and separated from each other at another end to be individually deformable.

5. A card-edge connector as defined in claim 4, wherein:

each of said first and second contact terminals comprises a plurality of terminal portions formed substantially in a same plane to be electrically connected by soldering, and each terminal portion is coupled to one end of a corresponding fixed portion and wherein another end of the corresponding fixed portion is coupled to a corresponding plurality of spring piece units.

6. A card-edge connector as defined in claim 4, wherein said connecting section of said edge board is nipped by the plurality of contact point sections in said first and second contact terminals.

7. A card-edge connector as defined in claim 4, wherein said positioning section is formed by a recess in an interior of said housing portion for holding and guiding said edge board and a bottom plate member to which an end of said connecting section of said edge board is brought into contact.

8. A card-edge connector for electrically connecting to a printed circuit board having a plurality of contact pads arranged on at least one side of an end portion of the printed circuit, comprising:

a connector housing having a recess into which the end portion of the printed circuit board is to be inserted, and a plurality of first contact terminals, wherein each first contact terminal is formed of a plurality of first contact units wherein the first contact units are stacked and wherein each first contact unit comprises a fixed part to be secured to said connector housing and an elastically deformable spring piece section extending from said fixed part and having a contact point section at a distal end thereof to contact with at least one contact pad on said printed circuit board when said end portion of said printed circuit board is inserted into said card-edge connector, wherein:

said plurality of stacked first contact units are configured so that the contact point sections are distributed to disperse in the lengthwise direction of said corresponding first contact terminal, and wherein each spring piece section of said plurality of stacked first contact units comprises a plurality of spring piece units disposed in a widthwise direction of said corresponding first contact terminal.

9. A card-edge connector as defined in claim 8, wherein each spring piece section of said plurality of stacked first contact units, except the spring piece section of an innermost first contact unit, comprises a fold at a midpoint thereby extending the spring piece section back toward the contact point section of the innermost first contact unit and forming a hook-shape.

10. A card-edge connector as defined in claim 9, wherein the contact point section of said innermost first contact unit is formed to be arcuate-shape.

11. A card-edge connector as defined in claim 9, wherein a distal end of said innermost first contact unit extends to a position at which it is not entangled with a distal end of an adjacent first contact unit.

12. A card-edge connector as defined in claim 9, wherein each contact point section of said plurality of stacked first contact units, except the contact point section of said innermost first contact unit is bent.

13. A card-edge connector as defined in claim 8, wherein the printed circuit board comprises a plurality of contact pads arranged on a first side and a second side of an end portion of the printed circuit and wherein each contact point section of said plurality of stacked first contact units makes contact with at least one contact pad on said first side of said printed circuit board when said end portion of said printed circuit board is inserted into said card-edge connector, the card-edge connector further comprising:

a plurality of second contact terminals, wherein each second contact terminal is formed of a plurality of second contact units, wherein the second contact units are stacked, and wherein each second contact unit comprises a fixed part to be secured to said connector housing and an elastically deformable spring piece section extending from said fixed part and having a contact point section at a distal end thereof to make contact with at least one contact pad on said second side of said printed circuit board when said end portion of said printed circuit board is inserted into said card-edge connector, wherein:

said plurality of stacked second contact units are configured so that the contact point sections are distributed to disperse in the lengthwise direction of said corresponding second contact terminal, and wherein each spring piece section of said plurality of stacked second contact units comprises a plurality of spring piece units disposed in a widthwise direction of said corresponding second contact terminal.

* * * * *